US007670208B2

(12) United States Patent
Thysell et al.

(10) Patent No.: US 7,670,208 B2
(45) Date of Patent: Mar. 2, 2010

(54) CARRIER PLATE HOLDING AN ABRADING ELEMENT AND ABRADING PLATE

(75) Inventors: Håkan Thysell, Söderköping (SE); Karl Thysell, Söderköping (SE); Lars Olsen, Kalmar (SE)

(73) Assignee: HTC Sweden AB, Soederkoeping (SE)

( * ) Notice: Subject to any disclaimer, the term of this patent is extended or adjusted under 35 U.S.C. 154(b) by 320 days.

(21) Appl. No.: 10/560,078

(22) PCT Filed: Jun. 10, 2004

(86) PCT No.: PCT/SE2004/000905

§ 371 (c)(1),
(2), (4) Date: Dec. 28, 2006

(87) PCT Pub. No.: WO2004/108352

PCT Pub. Date: Dec. 16, 2004

(65) Prior Publication Data

US 2008/0108286 A1 May 8, 2008

(30) Foreign Application Priority Data

Jun. 11, 2003 (SE) ..... 0301709

(51) Int. Cl.
*B24B 7/22* (2006.01)

(52) U.S. Cl. ..... 451/353; 451/548; 125/3

(58) Field of Classification Search ..... 125/3, 125/25, 9; 451/353, 350, 359, 548, 543, 451/41

See application file for complete search history.

(56) References Cited

U.S. PATENT DOCUMENTS

| | | | | |
|---|---|---|---|---|
| 1,470,957 | A | 10/1923 | Cavicchi | |
| 2,842,904 | A | 7/1958 | Ralys | |
| 3,291,583 | A * | 12/1966 | Lindblad | 51/293 |
| 4,641,628 | A * | 2/1987 | deKok | 125/15 |
| 5,076,023 | A | 12/1991 | Saguchi | |
| 5,567,503 | A * | 10/1996 | Sexton et al. | 428/143 |
| 5,683,143 | A | 11/1997 | Peterson et al. | |
| 7,192,339 | B1 * | 3/2007 | Harding | 451/487 |

FOREIGN PATENT DOCUMENTS

| | | |
|---|---|---|
| DE | 1 047 054 | 12/1958 |
| DE | 1 127 745 | 4/1962 |
| DE | 7232443 | 12/1972 |
| DE | 201 20 137 UI | 2/2002 |
| FI | 30 346 | 3/1960 |
| NO | 315191 B | 7/2003 |
| WO | PCT/SE93/00865 | 4/1994 |
| WO | WO 2004/108352 A3 | 12/2004 |

* cited by examiner

*Primary Examiner*—Robert Rose
(74) *Attorney, Agent, or Firm*—Oblon, Spivak, McClelland, Maier & Neustadt, L.L.P.

(57) ABSTRACT

The invention concerns a carrier plate (2) holding an abrading element, for detachable mounting on a rotatably mounted abrading plate (1) driven during use, for abrading stone or concrete floors, which carrier plate (2) has sides (2*a*, 2*b*) which form an acute angle with each other. The sides (2*a*, 2*b*) have flanges (2*a*1, 2*b*1) which are formed for surrounding engagement with a shoulder (1*a*) arranged on the abrading plate (1) so that the carrier plate (2) can be fixed on the abrading plate (1) with an engagement based on form and friction.

4 Claims, 2 Drawing Sheets

CARRIER PLATE HOLDING AN ABRADING ELEMENT AND ABRADING PLATE

TECHNICAL FIELD

The present invention concerns a carrier plate holding an abrading element and an abrading plate device according to the preamble of the respective independent claims.

TECHNICAL BACKGROUND

A machine, preferably for abrading stone and concrete floors, is known for example from PCT/SE93/00865. The abrading element, fixed on a carrier plate which in turn is detachably mounted on the abrading plate, must be considered a consumable. Changing the abrading element is labour-intensive and time-consuming, and adversely affects the production time of the abrading machine.

Examples of known devices for detachable mounting of abrading elements on abrading discs are shown in DE-1 127 745, U.S. Pat. No. 1,470,957 and U.S. Pat. No. 5,076,023.

SUMMARY OF THE INVENTION

The object of the present invention is to produce a device of the type described initially which facilitates the replacement of the abrading element and hence contributes to a better working environment and increased production.

The invention is defined by the enclosed independent claim. Embodiments arise from the enclosed dependent claims and the following descriptions and enclosed drawings.

Thus a carrier plate holding an abrading element is produced, for detachable mounting on a rotatably mounted abrading plate driven during use, for abrading stone or concrete floors, which carrier plate has sides which form an acute angle with each other. The carrier plate is characterised in that the sides have flanges which are designed for surrounding engagement with a shoulder arranged on the abrading plate so that the carrier plate can be fixed on the abrading plate with an engagement based on form and friction.

An abrading plate is also produced for abrading stone or concrete floors, which abrading plate is rotatably mounted and driven during use and formed for detachable mounting of at least one carrier plate holding an abrading element. The abrading plate is characterised by a shoulder arranged on the abrading plate which has side edges forming an acute angle with each other and which is designed for engagement with flanges arranged on the carrier plate so that the carrier plate by surrounding engagement can be fixed on the abrading plate in an engagement based on form and friction.

The invention thus achieves the simplified mounting of carrier plates on the abrading plate, which mounting is also quick to both establish and release.

As a particular characteristic of the invention shows, because of the acute angle between the undercut groove and naturally also between the corresponding edges shaped complementary to the groove on the carrier plate, the engagement between the groove and the carrier plate edges can be established and released very quickly.

Carrier plates according to the invention also have the advantage that they can be produced at relatively low cost.

BRIEF DESCRIPTION OF THE DRAWINGS

The invention will be explained below in more detail with reference to the enclosed drawings.

DESCRIPTION OF EMBODIMENTS

Figure 1:
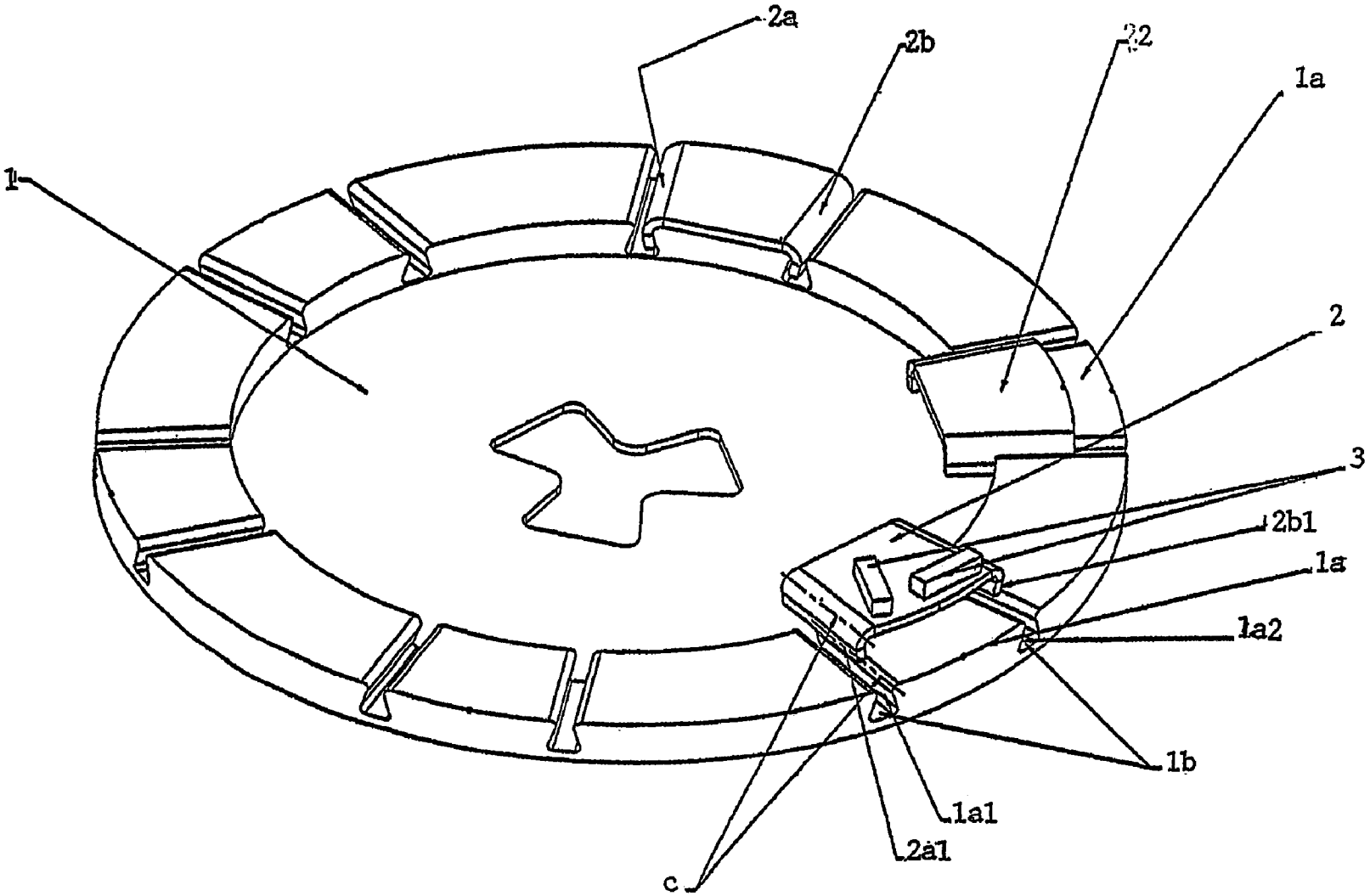
FIG. 1 shows a preferred embodiment of the device according to the invention.

On the drawing 1 indicates an abrading plate which is mounted rotatably and for abrasion is driven by a motor as is explained in more detail in the patent publication cited initially. On the abrading plate is detachably fixed a number of carrier plates 2 positioned according to a predetermined pattern, each supporting a number of abrading segments 3 placed in a predetermined manner on the carrier plate 2.

The carrier plates 2 each have two sides 2*a*, 2*b* which form an acute angle with each other and on the abrading plate 1 are a number of elements 1*a* positioned according to the said pattern and complementary to the sides 2*a*, 2*b* of the respective carrier plate. The sides 2*a*, 2*b* and the element edges stand in an undercut relationship to each other and are directed so that a radius from the centre of the abrading plate divides the acute angle pointing towards the abrading plate centre 1 into two essential equal parts.

The sides 2*a*, 2*b* of the carrier plate 2 are formed with downward and inward pointing flanges 2*a*1, 2*b* 1, where the transition between the plane of the abrading plate and the plane of flanges 2*a*1, 2*b*1 is rounded so that for reasons of production and strength the flanges are curved about an imaginary axis c parallel to the sides 2*a*, 2*b* of the carrier plate 2. In the preferred embodiment shown in FIG. 1, the said complementary-shaped element 1 comprises a shoulder 1*a* formed by a radial groove 1*b* produced in the abrading plate 1, the side edges 1*a*1, 1*a*2 of which are intended to stand in engagement with the sides 1*a*1, 1*a*2 surrounding the flanges 2*a*1, 2*b*1. The tip of the acute angle points radially inwards so that the forces occurring on abrasion prevent the carrier plate 2 from leaving the protrusion 1*a*. This achieves the advantage that the carrier plate 2 is held on the protrusion 1*a* with an engagement based on friction.

Figure 2:
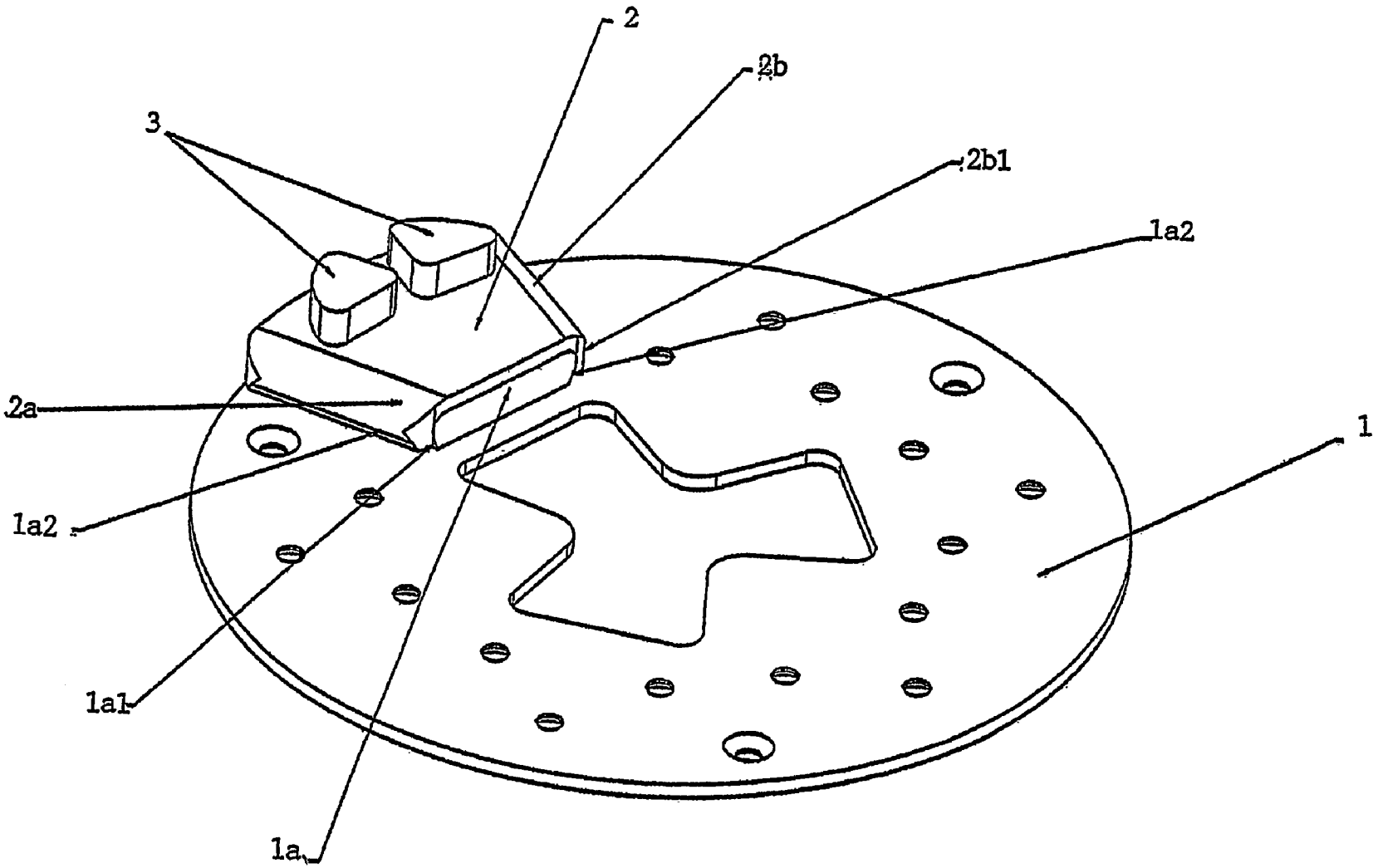
FIG. 2 shows an alternative embodiment of the invention.

In the embodiment in FIG. 2 the element 1*a* comprises protrusions projecting from the abrading plate 1, otherwise the statements above relating to the embodiment in FIG. 1 apply accordingly.

The invention claimed is:

1. A carrier plate detachably mounted on a rotatably mounted abrading plate that is driven during use to abrade stone or concrete floors, the carrier plate comprising:

a top surface having a first edge shorter than an opposing second edge;

an abrading element affixed to the top surface;

a first side arranged on a third edge of the top surface;

a second side arranged on a fourth edge of the top surface, the fourth edge opposing the third edge, the first and second sides forming an acute angle; and two flanges, each flange arranged on a respective one of the first and second sides, the two flanges being provided to engage a shoulder arranged on the abrading plate by surrounding said shoulder to affix the carrier plate on the abrading plate with an engagement based on form and friction, said flanges being angled inwards towards a centerline of the carrier plate and downwards towards the abrading plate.

2. An apparatus for abrading stone or concrete floors comprising:

an abrading plate provided to be rotatably driven during use;

a carrier plate detachably mounted on the abrading plate and including an abrading element;

a first side provided to form an acute angle with respect to a second side, the acute angle pointing towards a center of the abrading plate, a radius from the center of the abrading plate dividing the each of the acute angle and the carrier plate into equal parts; and two flanges, each flange arranged on a respective one of the first and second sides, the two flanges being provided to engage a shoulder arranged on the abrading plate by surrounding said shoulder to axially affix the carrier plate on the abrading plate within a circumference of the abrading plate, the carrier plate being affixed with an engagement based on form and friction, the two flanges being angled inward toward a centerline of the carrier plate.

3. A carrier plate detachably mounted on a rotatably mounted abrading plate driven during use to abrade stone or concrete floors, the carrier plate comprising:

a top surface having a first edge shorter than an opposing second edge;

an abrading element affixed to the top surface;

a first side arranged on a third edge of the top surface;

a second side arranged on a fourth edge of the top surface, the fourth edge opposing the third edge, the first and second sides forming an acute angle; and two flanges, each flange arranged on a respective one of the first and second sides, the two flanges being provided to engage a shoulder arranged on the abrading plate by surrounding said shoulder to affix the carrier plate can on the abrading plate with an engagement based on form and friction, the flanges being rounded about an axis parallel to the respective sides to contact complementary-shaped surfaces on the shoulder of the abrading plate.

4. The abrading apparatus according to claim 2, wherein the two flanges are rounded about an axis parallel to the respective sides to contact complementary-shaped surfaces on the shoulder of the abrading plate.

* * * * *